United States Patent [19]

Rohanna

[11] 4,438,831

[45] Mar. 27, 1984

[54] ELEVATOR SYSTEM

[75] Inventor: James E. Rohanna, Gettysburg, Pa.

[73] Assignee: Westinghouse Electric Corp., Pittsburgh, Pa.

[21] Appl. No.: 110,280

[22] Filed: Jan. 7, 1980

[51] Int. Cl.[3] ..... B66B 1/00

[52] U.S. Cl. ..... 187/30; 187/17; 187/29 R

[58] Field of Search ..... 187/17, 30, 47, 51, 187/29 R, 29 A, 1 R; 60/431, 452; 414/631, 629; 91/451, 452, 449; 340/666, 667

[56] References Cited

U.S. PATENT DOCUMENTS

| | | | |
|---|---|---|---|
| 372,361 | 11/1887 | Daft | 60/431 |
| 1,122,497 | 12/1914 | Freer et al. | 187/30 |
| 2,173,289 | 9/1939 | Staley | 187/29 R |
| 2,611,246 | 9/1952 | Ackerman | 60/431 |
| 2,644,546 | 7/1953 | Doolan | 340/666 |
| 3,831,492 | 8/1974 | Young | 187/17 |
| 3,902,573 | 9/1975 | Grove | 187/29 R |
| 3,942,413 | 3/1976 | Schwarz et al. | 91/451 |
| 4,078,623 | 3/1978 | Ohta | 177/45 |
| 4,210,170 | 7/1980 | Sutton | 91/451 |

*Primary Examiner*—Joseph J. Rolla
*Assistant Examiner*—Kenneth Noland
*Attorney, Agent, or Firm*—D. R. Lackey

[57] ABSTRACT

A hydraulic elevator system wherein the pressure in the hydraulic system is used to measure load in the passenger compartment of the elevator car when the elevator car is stationary. A pressure monitoring device, such as a pressure switch, is calibrated to provide a signal when a predetermined pressure is reached, with this signal being used to modify the operation of the elevator system.

4 Claims, 5 Drawing Figures

ELEVATOR SYSTEM

BACKGROUND OF THE INVENTION

1. Field of the Invention

The invention relates in general to elevator systems, and more specifically to hydraulic elevator systems which utilize load weighing devices.

2. Description of the Prior Art

The jack assembly and power units of a hydraulic elevator system are selected according to the size and capacity of the cab desired by the user, the rise, and the desired speed. The cab and its sling, collectively called an elevator car, has a predetermined weight, and a predetermined rated capacity, and the plunger of the jack assembly initially selected to accommodate the gross weight and rise has a predetermined weight per foot. Thus, the gross weight is calculated and checked with jack capacity to ensure that the jack selected is proper for the application. If not, the next higher jack size is used in the calculations, until the proper jack size is found. Using the gross weight, area of jack bottom and seal friction pressure, the pressure required at the jack is calculated. The pressure loss from the power unit to the jack is then calculated, using the distance from the power unit to the jack, the elbows, etc., to determine the pressure required at the power unit in order to provide the required pressure at the jack assembly. The power unit capable of providing this pressure is then selected, which thus selects the horsepower and frame of the electric drive motor, and the pump size.

The calculations include a factor of safety which permits occasional overloading of the elevator car without damage to the equipment. However, if the environment in which the elevator system is to be installed is such that it may be subjected to frequent and/or excessive overloads, beyond about 25% of rated load, it would be desirable to monitor car load and to prevent the operation of the elevator car when the load exceeds a predetermined value. Also, when the load in the elevator car reaches rated load, it would improve service if hall calls are by-passed. Prior art arrangements for measuring the load in an elevator car, however, are quite costly, usually detecting the deflection of a yieldable platform via a plurality of switches adjusted to be actuated in response to a predetermined deflection, and thus load, on the platform. The switches are difficult to adjust, because of their location, and a required periodic readjustment to ensure accuracy.

SUMMARY OF THE INVENTION

Briefly, the present invention is a new and improved hydraulic elevator system in which the hydraulic system is used to weigh the load in the elevator car when the elevator car is stationary. When the elevator car is stationary, the fluid pressure is responsive to the combined weight of the elevator car, the load in the passenger compartment, and the weight of the plunger. Pressure responsive means, such as one or more pressure switches, are disposed to monitor the hydraulic pressure. Each switch device is calibrated such that when a predetermined load is reached, such as rated load, 15% above rated load, or 25% above rated load, it provides a predetermined signal. One of the predetermined signals may be used to initiate by-passing of hall calls. Still others may be used to prevent operation of the elevator car and/or provide an indication in the passenger compartment that the car is overloaded. If a two step overload indication is desired, two pressure responsive devices may be used, calibrated such that one device indicates a first predetermined level of overload, which may provide an audible and/or visual indication in the elevator car that load should be removed. However, acutation of this first level of overload will not prevent operation of the elevator system, if the first overload signal is ignored. If the overload, however, reaches the calibrated setting of the second pressure responsive device, operation of the elevator system will be prevented until the overload is reduced below the pressure setting of the second pressure responsive device.

In a preferred embodiment of the invention, the load weighing function is enabled when the doors of the elevator car and hoistway reach their fully open positions. The need for by-passing hall calls is monitored during the door open time, and this feature is enabled for the subsequent run if the car load reaches rated load. Closure of the doors may be prevented if the elevator car load reaches a predetermined overload condition, which will thus prevent operation of the elevator car until load is removed and the overload signal ceases. Each time the doors of the elevator car and hoistway close, the load weighing function is inhibited as there is no longer any need for the load weighing function, and also because the hydraulic pressure may increase above the calibrated load weighing settings during acceleration of the elevator car.

BRIEF DESCRIPTION OF THE DRAWING

The invention may be better understood, and further advantages and uses thereof more readily apparent, when considered in view of the following detailed description of exemplary embodiments, taken with the accompanying drawings in which.

DESCRIPTION OF PREFERRED EMBODIMENTS

Figure 1:
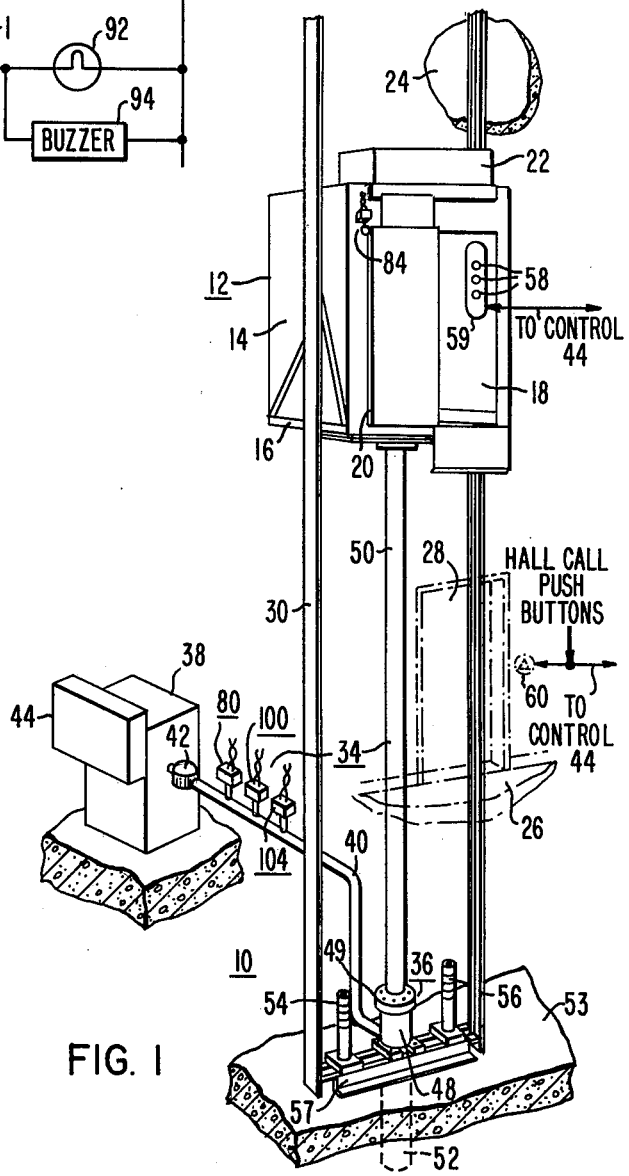
FIG. 1 is a perspective view of a hydraulic elevator system constructed according to the teachings of the invention.

Referring now to the drawings, and to FIG. 1 in particular, there is shown a hydraulic elevator system 10 constructed according to the teachings of the invention. Elevator system 10 includes an elevator car 12 comprising a passenger cab 14 mounted on a sling and platform assembly 16. Cab 14 defines a passenger compartment, which has an opening 18, a door 20 for the opening, and a door operator 22 which slidably operates the door 20 between the open position illustrated in FIG. 1, and a closed position.

Elevator car 12 is mounted for guided vertical movement in the hoistway 24 of a structure or building having floors to be served by the elevator car, such as floor 26 shown in phantom. Floor 26 includes a hoistway door 28 which is operated in unison with the car door 20 when the elevator car 12 is located at floor 26.

Elevator car 12 is guided and stabilized in its vertical travel path via guide rails 30 and 32 suitably attached to the walls of hoistway 24 via rail brackets (not shown), and guide roller assemblies (not shown) on the elevator car 12 which coact with the guide rails. Motive means for elevator car 12 includes a hydraulic system 34 comprising a jack assembly 36, a hydraulic power unit 38, suitable piping 40 which provides fluid flow communication between the power unit 30 and jack assembly 36, and a hydraulic muffler 42 to dampen fluid pulsations originating in the power unit. An electrical control panel 44, usually mounted on the power unit 38, includes the car control and power unit control, such as a line contactor 46 shown in FIG. 2, door relays, such as door relay 45R shown in FIG. 3, direction relays, and a floor selector.

The jack assembly 36 includes a cylinder 48 which defines a fluid chamber, a cylinder head 49, and a plunger 50. Jack assembly 36 is illustrated in the conventional mounting arrangement with the cylinder 48 disposed to extend into a jack hole 52 and with the platen plate on the plunger 50 secured to the bolster plate on the car bolster. However, the invention applies to any hydraulic jack mounting arrangement, such as a holeless arrangement wherein the cylinder is fastened to the elevator car and the plunger is fastened in the pit 53 at the bottom of the hoistway. Conventional spring buffers 54 and 56 are also mounted in the pit 53, such as by attaching the buffers to footing channels 57.

Elevator car 12 is controlled via car call pushbuttons 58 mounted in a car station 59 in the passenger compartment of cab 14, and via a plurality of hall call pushbuttons, such as pushbutton 60, located in the hallways of the various floors.

Figure 2:
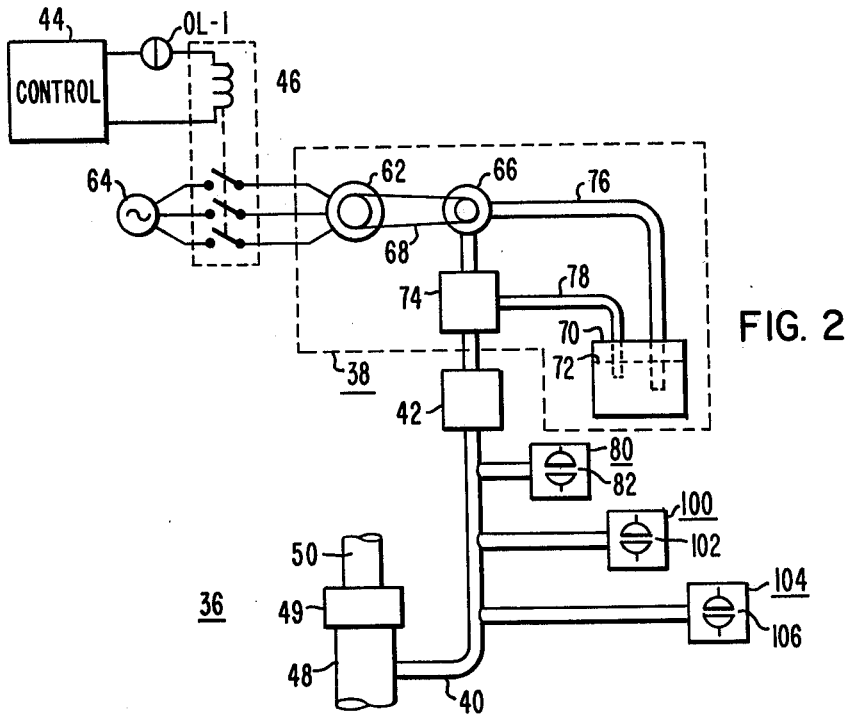
FIG. 2 is a partially schematic and partially diagrammatic view of the elevator system shown in FIG. 1.

FIG. 2 illustrates the power unit 38 in greater detail. Power unit 38 includes an electric motor 62 connected to a source 64 of alternating potential via a circuit breaker or line contactor 46, with motor 62 being suitably coupled to a hydraulic pump 66 via a drive belt 68. Power unit 38 additionally includes a supply or tank 70 containing hydraulic fluid 72, such as oil, and a control valve 74. Control valve 74 may be a conventional hydraulic elevator valve which contains up and down travel direction valves in one unit, controlled by solenoid pilot valves.

When a car call or hall call is entered via an appropriate push button which requires the elevator car 12 to travel in the up travel direction, control 44 selects the up valve in the control valve 74, and it actuates contactor 46 to energize motor 62. Pump 66 draws hydraulic fluid 72 from tank 70 via pipe 76 and forces it at an elevated pressure into the piping 40, via the up valve and muffler 42, and thus into the fluid chamber of the cylinder 48. The pressure on the bottom of the plunger 50 causes the plunger and elevator car 12 to rise until suitable control in the hoistway, such as cams and switches (not shown), indicates the elevator car is at the target floor. The speed of the car during up travel is determined by the rate at which oil is pumped into the cylinder 48. The elevator car is held at rest by deenergizing the drive motor and by checking the flow of oil from the cylinder. When a car or hall call requiring down travel is entered via an appropriate pushbutton, control 44 selects the down valve in the control valve 74, which allows oil to flow back into tank 70 via conduit or pipe 78, at a rate which determines the car speed.

While the hydraulic system described is the most common, it is to be understood that the invention applies equally to any type of hydraulic drive systems for elevators, such as those employing the variable displacement pumps, which operate the pump for both the up and down travel directions.

When the flow of oil is checked and the elevator car 12 is stationary, the fluid pressure in the hydraulic system 34 is responsive to the weight of the elevator car 12, the load in the passenger compartment of the cab 14, and the weight of the plunger 50. The present invention monitors the fluid pressure when the elevator car 12 is at rest or stationary, to detect full load and/or overload conditions. Upon detecting full load, or an overload, a predetermined signal is provided, which provides a predetermined control function, as will be hereinafter explained.

More specifically, according to a first embodiment of the invention, the fluid pressure is monitored via a pressure switch 80 having at least one set 82 of electrical contacts which are actuated from a first condition to a second condition when the pressure in the hydraulic system reaches a predetermined magnitude. Drop in pressure below this magnitude operates the contacts from the second condition back to the first condition. Pressure switch 80 is disposed in fluid pressure communication with the hydraulic system 34 via a suitable hydraulic fitting disposed between the control valve 74 and the fluid inlet of cylinder 48.

The required calibration of the pressure switch 80 is easily calculated. For example, if the weight of the elevator car 12 and its rated load is 5300 pounds, the plunger for the associated rise weighs 673 pounds, and the area on the bottom of the plunger is 15.81 square inches, the pressure in the hydraulic system when the elevator car is standing with rated load in its passenger compartment is equal to 5,973 divided by 15.81, or about 378 psi. If it is desired to provide an overload signal when the overload reaches 25% of rated load, and rated load is 2500 pounds, the pressure in the hydraulic system at 25% overload will be 6,598 divided by 15.81, or about 411 psi. Thus, the pressure switch 80 would be calibrated to operate at a pressure of about 411 psi.

The only time that it is necessary to monitor the load in the elevator car is when the elevator car 12 is stationary with its door 20 open. Further, it is not desirable to provide an overload signal responsive to hydraulic pressure once the elevator car is moving, since the pressure may no longer be used to accurately indicate car load, and it would be undesirable to provide an overload signal while the elevator car is moving, which would result in stopping of the car.

In a preferred embodiment of the invention, the positions of the car door 20 are used to enable, and disable, the load monitoring feature, with the load monitoring function being enabled when the door 20 is fully open, and otherwise disabled. A door switch 84 may be used to signal the fully open position of door 20.

An overload signal may be used, for example, to provide a visual signal, an audible signal, or to modify the operation of the elevator system, or any combination of these functions. Since normal elevator controls prevent car movement until the car and hoistway doors are closed, in a preferred embodiment of the invention an overload signal is used to prevent the door 20 from closing until the overload is removed. A visual and/or an audible signal in the passenger compartment is coupled with this modification of the door circuits to notify the passengers that an overload exists and that the elevator car will not move until the overload condition is corrected. This embodiment is set forth in FIG. 3, which is a schematic diagram of a portion of control 44 shown in block form in FIGS. 1 and 2.

Figure 3:
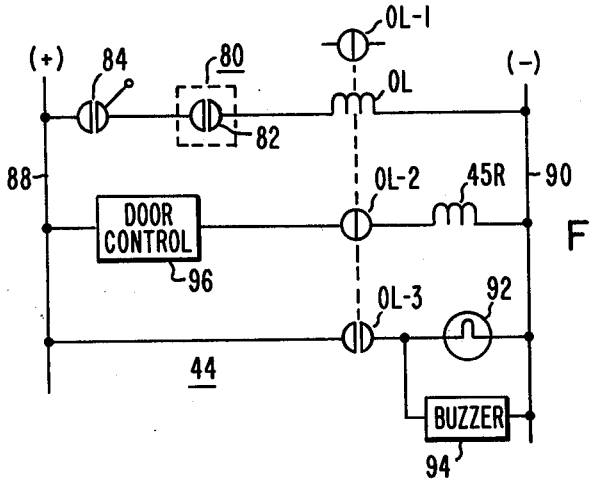
FIG. 3 is a schematic diagram of certain of the electrical controls shown in block form in FIGS. 1 and 2, related to an overload monitoring function constructed according to an embodiment of the invention.

More specifically, the electrical control of FIG. 3 includes a source of electrical potential, indicated by conductors 88 and 90, an overload relay OL having n.c. contacts OL-1 and OL-2 and n.o. contacts OL-3, a door relay 45R, an overload indicating light 92, and an audible alarm or buzzer 94. The overload relay OL is connected between conductors 88 and 90 via the contacts 82 of pressure switch 80 and the door switch 84. Overload relay OL is energized when an overload is detected, and thus contacts 82 of pressure switch 80 are normally open, closing when the predetermined calibrated pressure is reached. The door switch 84 is normally open, closing its contacts only when door 20 is in the fully open condition. Thus, when door 20 is open and the door switch 84 closes, the overload feature is enabled. When the electrical contacts associated with door switch 84 are open, signifying that the door 20 is closing, or is closed, the overload monitoring feature is inhibited or disabled.

Door relay 45R is connected between conductors 88 and 90 via the normal door circuits, shown generally at 96, and via the n.c. contacts OL-2 of the overload relay OL. Door 20 is operated to its open position when relay 45R is deenergized, and it is operated to its closed position when relay 45R is energized. If no overload exists, contacts OL-2 are closed and the door circuits operate normally. If an overload exists, pressure switch 80 closes its contacts 82, relay OL picks up and contacts OL-2 open. Thus, relay 45R cannot be energized by door control 96 at the end of the normal non-interference time, and door 20 will remain open until the overload condition is removed. Since the car cannot be moved when its door 20 is open, it is unnecessary to modify the control of the power unit 38. However, for purposes of example, n.c. contacts OL-1 are illustrated in FIG. 2 connected in the circuit of the line contactor 46, preventing drive motor 62 from being energized while an overload exists.

Since the passengers will not understand why the door 20 will not close, it is necessary to notify them of the overload condition so passengers and/or equipment may be removed until the overload condition has been corrected. This may be accomplished with a light 92, which may illuminate an appropriate legend on the car control panel 58, and a buzzer 94 which directs the passengers' attention to the car panel. Light 92 and buzzer 94 are connected between conductors 88 and 90 via the n.o. set of contacts OL-3.

Figure 4:
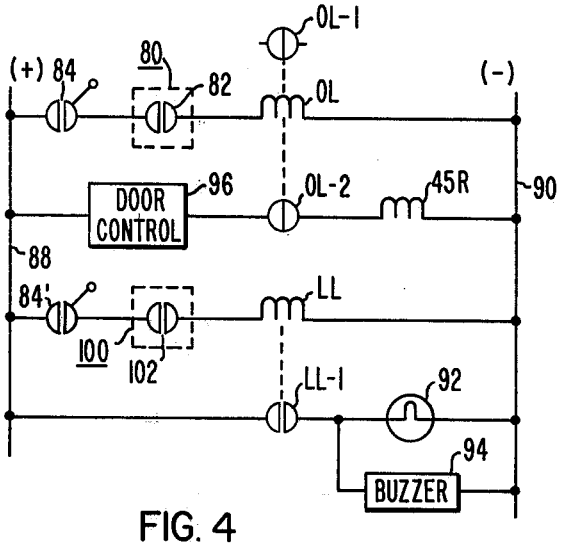
FIG. 4 is a schematic diagram illustrating an overload monitoring function constructed according to an other embodiment of the invention.

FIG. 4 is a schematic diagram which illustrates another embodiment of the invention, with this embodiment being similar to the embodiment shown in FIG. 3 except two separate pressure switches are used. In addition to pressure switch 80, a pressure switch 100 is provided which is calibrated to operate at a lower hydraulic pressure than pressure switch 80. For example, the pressure switch 100 may be set to operate at 15% overload, and pressure switch 80 may be set to operate at 25% overload. Pressure switch 100 has n.o. contacts connected to energize a relay LL when its pressure has been reached and the doors are open. Relay LL has contacts LL-1 which replace contacts OL-3 in the FIG. 3 embodiment. Thus, the light 92 and buzzer 94 will be energized, and, the passengers will be encouraged to remove a load from the car when the overload reaches 15%. However, if they do not remove the over load, and the overload is less than 25%, the elevator car will still operate normally. If the overload reaches 25%, the elevator car will then be prevented from operating until the overload is reduced below this value.

Figure 5:
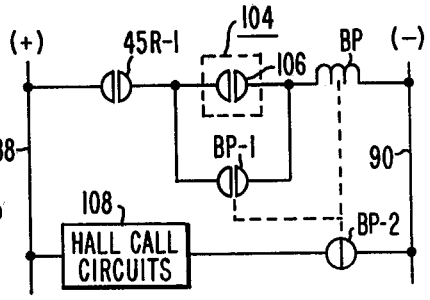
FIG. 5 is a schematic diagram illustrating a hall call by-pass function related to car load, constructed according to another embodiment of the invention.

FIG. 5 is a schematic diagram which sets forth an embodiment of the invention related to hall call by-passing. This embodiment may be used alone, or in combination with either of the embodiments of FIG. 3 or 4. This embodiment utilizes a pressure switch 104 disposed to monitor pressure in the hydraulic system in the same manner as pressure switches 80 and 100, with pressure switch 104 being calibrated to actuate its contacts at rated load. For example, pressure switch 104 may have n.o. contacts 106 which close at the desired pressure. Using the example hereinbefore set forth, pressure switch 104 would be calibrated to be actuated at a pressure of 378 psi.

Contacts 106 are connected to actuate a hall call by-pass relay BP if they are closed, indicating rated load or greater, such as when the door relay 45R is energized to initiate door closing. Contacts 45R-1 of relay 45R, which are n.o., may be used to provide this function. Once relay BP picks up, it seals-in around contacts 106 via n.o. contacts BP-1.

Relay BP, when energized, enables the hall call by-pass function to be operational during the subsequent run. Relay BP is reset at the end of each run, such as by contacts 45R-1 opening when relay 45R drops to initiate door opening. Relay BP includes contacts BP-2 in the hall call circuits 108, with the change in their condition when relay BP is energized, preventing the elevator car from answering hall calls. For example, contacts BP-2 may be n.c., opening at rated load to prevent the elevator car from answering a hall call.

I claim as my invention:

1. An elevator system, comprising:

a structure having floors and a hoistway, an elevator car in the hoistway of said structure for serving the floors therein, said elevator car having a passenger compartment for accommodating a load, motive means for said elevator car including a hydraulic system which includes fluid means under pressure, with the pressure of said fluid means being responsive to the weight of said elevator car and the load in its passenger compartment when the elevator car is stationary, load monitoring means responsive to the pressure of the fluid means in said hydraulic system when the elevator car is stationary, with said load monitoring means providing a predetermined signal when the magnitude of the pressure in the hydraulic system indicates the load in the passenger compartment exceeds a predetermined magnitude, a door on said elevator car operable between open and closed positions, and means responsive to the position of said door for inhibiting the load monitoring means from providing the predetermined signal unless the door is in the open position.

2. The elevator system of claim 1 wherein the predetermined signal prevents the elevator door from being operated to its closed position.

3. The elevator system of claim 2 including means in the passenger compartment responsive to the predetermined signal for notifying the passengers of the overloaded condition.

4. An elevator system, comprising:

a structure having floors and a hoistway, an elevator car in the hoistway of said structure for serving said floors, said elevator car having a passenger compartment for accommodating a load, and a door to the passenger compartment operable between open and closed positions, a jack including a cylinder having a fluid chamber and a fluid actuated plunger, said jack being disposed such that actuation of said plunger causes movement of said elevator car, a hydraulic system for supplying hydraulic fluid under pressure to the fluid chamber of said jack to actuate the plunger, with the pressure of the hydraulic fluid, when the elevator car is stationary, being responsive to the weight of said elevator car and the load in its passenger compartment, a pressure switch in pressure responsive communication with the hydraulic fluid, said pressure switch being calibrated to provide a predetermined signal when the pressure of said hydraulic fluid indicates the load in the passenger compartment of said elevator car exceeds a predetermined magnitude, and control means responsive to the door of said elevator car being in its open position and to said pressure switch providing said predetermined signal for preventing closure of said door until the load in the passenger compartment is reduced to the point where said pressure switch ceases to provide the predetermined signal.

* * * * *